US008360030B2

(12) United States Patent
Walker et al.

(10) Patent No.: US 8,360,030 B2
(45) **Date of Patent: *Jan. 29, 2013**

(54) IDLE SPEED REDUCTION SYSTEMS AND METHODS

(75) Inventors: Lee C. Walker, Swartz Creek, MI (US); B. Jerry Song, Novi, MI (US); Joseph Allen Griffin, Grand Blanc, MI (US); Byungho Lee, Ann Arbor, MI (US)

(73) Assignee: GM Global Technology Operations LLC

( * ) Notice: Subject to any disclaimer, the term of this patent is extended or adjusted under 35 U.S.C. 154(b) by 430 days.

This patent is subject to a terminal disclaimer.

(21) Appl. No.: 12/725,950

(22) Filed: Mar. 17, 2010

(65) Prior Publication Data

US 2011/0226216 A1 Sep. 22, 2011

(51) Int. Cl.
*F02D 1/00* (2006.01)

(52) U.S. Cl. ..... 123/339.1; 123/339.19

(58) Field of Classification Search ..... 123/339.1, 123/339.14, 339.16, 339.19, 339.28; 701/114, 701/115

See application file for complete search history.

(56) References Cited

U.S. PATENT DOCUMENTS

| | | | | |
|---|---|---|---|---|
| 5,681,238 | A * | 10/1997 | Minowa et al. | 477/102 |
| 5,847,644 | A * | 12/1998 | Weisman et al. | 340/439 |
| 6,109,236 | A * | 8/2000 | Takahashi et al. | 123/339.19 |
| 6,600,988 | B1 * | 7/2003 | Da et al. | 701/93 |
| 7,282,011 | B2 * | 10/2007 | Tabata et al. | 477/109 |
| 7,950,368 | B2 * | 5/2011 | Pursifull et al. | 123/406.53 |
| 8,157,035 | B2 * | 4/2012 | Whitney et al. | 180/65.265 |

* cited by examiner

*Primary Examiner* — John Kwon

(57) ABSTRACT

An idle control system for a vehicle comprises an actuator control module, a torque determination module, a deviation analysis module, and an idle speed reduction module. The actuator control module regulates an engine speed based on a desired idle speed when an engine idle mode is enabled. The torque determination module determines actual torques for a cylinder of an engine while the engine idle mode is enabled. The deviation analysis module determines a standard deviation based on more than one of the actual torques while the engine idle mode is enabled. The idle speed reduction module determines an idle speed reduction based on the standard deviation and decreases the desired idle speed based on the idle speed reduction.

20 Claims, 3 Drawing Sheets

IDLE SPEED REDUCTION SYSTEMS AND METHODS

FIELD

The present disclosure relates to internal combustion engines and more particularly to engine control systems.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Air is drawn into an engine through an intake manifold. A throttle valve controls airflow into the engine. The air mixes with fuel provided by one or more fuel injectors to form an air/fuel mixture. The air/fuel mixture is combusted within one or more cylinders of the engine. In diesel engine systems, combustion is initiated by injection of the fuel into the cylinders. More specifically, heat provided by compression ignites injected fuel.

Combustion of the air/fuel mixture produces drive torque. More specifically, drive torque is generated through heat release and expansion that occurs during combustion of the air/fuel mixture within the cylinders. Torque is transferred by a crankshaft of the engine through a driveline (not shown) to one or more wheels to propel a vehicle. Exhaust gas is expelled from the cylinders to an exhaust system.

An engine control module (ECM) controls the torque output of the engine based on a desired torque. The desired torque may be based on driver inputs, such as accelerator pedal position, brake pedal position, cruise control inputs, and/or other suitable driver inputs. The desired torque may also be based on torque requested by other vehicle systems, such as a transmission control system, a hybrid control system, and/or a chassis control system. The ECM controls the torque output of the engine by controlling various engine operating parameters, such as airflow into the engine and fuel injection.

SUMMARY

An idle control system for a vehicle comprises an actuator control module, a torque determination module, a deviation analysis module, and an idle speed reduction module. The actuator control module regulates an engine speed based on a desired idle speed when an engine idle mode is enabled. The torque determination module determines actual torques for a cylinder of an engine while the engine idle mode is enabled. The deviation analysis module determines a standard deviation based on more than one of the actual torques while the engine idle mode is enabled. The idle speed reduction module determines an idle speed reduction based on the standard deviation and decreases the desired idle speed based on the idle speed reduction.

An idle control method for a vehicle comprises: regulating an engine speed based on a desired idle speed when an engine idle mode is enabled; determining actual torques for a cylinder of an engine while the engine idle mode is enabled; determining a standard deviation based on more than one of the actual torques while the engine idle mode is enabled; determining an idle speed reduction based on the standard deviation; and decreasing the desired idle speed based on the idle speed reduction.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
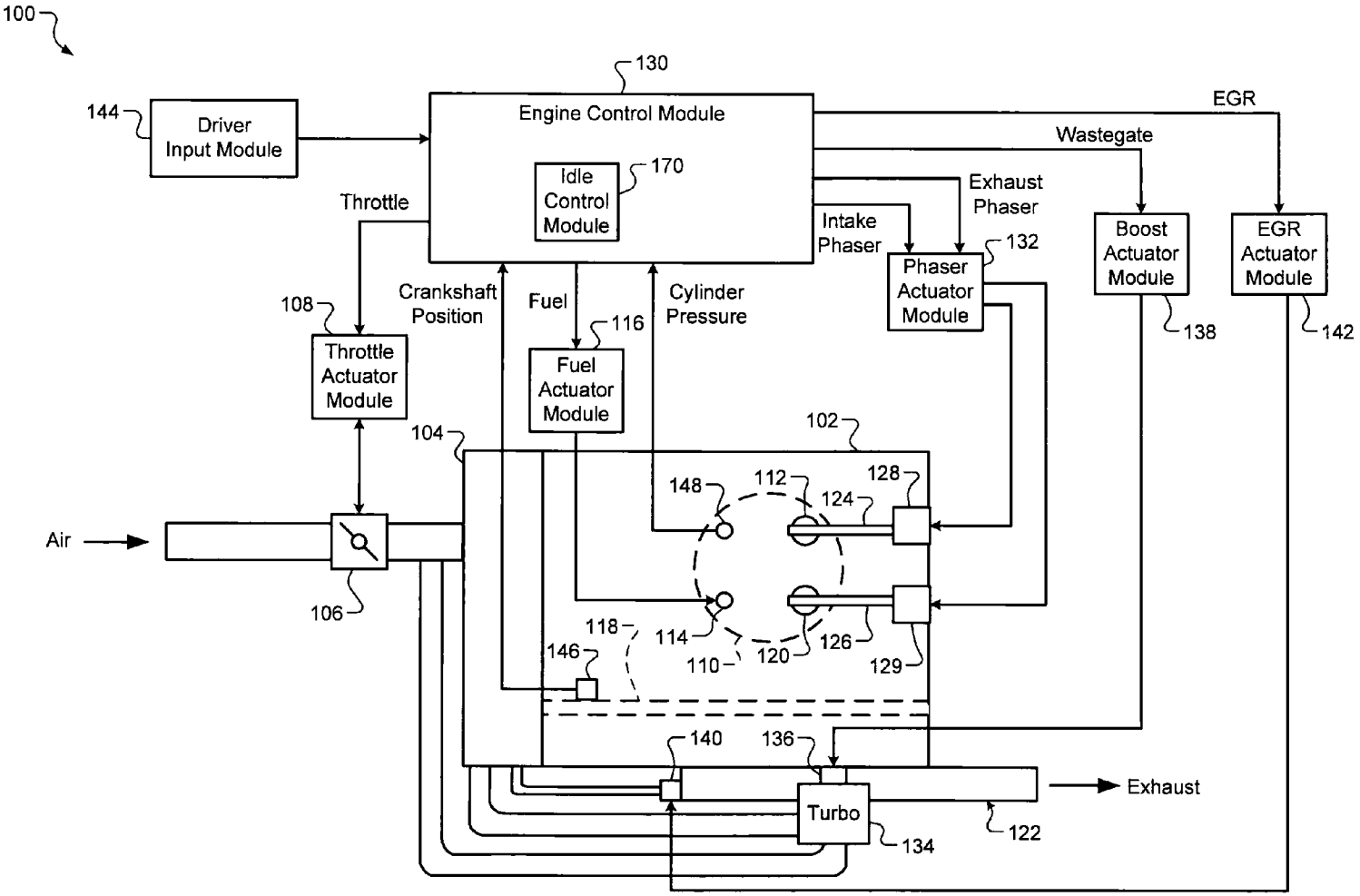
FIG. 1 is a functional block diagram of an exemplary diesel engine system according to the principles of the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

A diesel-type internal combustion engine combusts a mixture of air and diesel fuel to generate drive torque. While the engine is idling, an engine control module (ECM) controls torque output by the engine to maintain engine speed at approximately a desired idle speed. The desired idle speed may initially be set to a predetermined idle speed.

An ECM according to the present disclosure may determine an actual torque produced by each cylinder of the engine and adjusts the amount of fuel supplied to each of the cylinders to balance torque production across the cylinders. The ECM determines a standard deviation of the actual torques for each of the cylinders. The ECM determines an idle speed reduction based on the standard deviation and reduces the desired idle speed based on the idle speed reduction.

Referring now to FIG. 1, a functional block diagram of an exemplary diesel engine system 100 is presented. The diesel engine system 100 includes an engine 102 that combusts a mixture of air and diesel fuel to produce drive torque. One or more motor-generators (not shown) that selectively produce drive torque may also be implemented. Air is drawn into an intake manifold 104 through a throttle valve 106. A throttle actuator module 108 controls opening of the throttle valve 106 and, therefore, airflow into the engine 102. The throttle actuator module 108 may include, for example, an electronic throttle controller (ETC).

Air from the intake manifold 104 is drawn into cylinders of the engine 102. While the engine 102 includes multiple cylinders, for illustration purposes only, only a single representative cylinder 110 is shown. For example only, the engine 102 may include 2, 3, 4, 5, 6, 8, 10, and/or 12 cylinders. Air from the intake manifold 104 is drawn into the cylinder 110 through an associated intake valve 112. Lowering of a piston (not shown) within the cylinder 110 draws air into the cylinder 110.

After the piston reaches a bottom most position, referred to as bottom dead center (BDC), the piston rises and compresses the air within the cylinder 110. Compression of the air within the cylinder 110 generates heat. In some engine systems, fuel is injected into the cylinder 110 as air is drawn into the cylinder 110 and/or during compression.

An engine control module (ECM) 130 controls the amount (e.g., mass) of fuel injected by a fuel injector 114. More specifically, a fuel actuator module 116 controls opening of the fuel injector 114 based on signals from the ECM 130. For example only, the fuel actuator module 116 may control the period of time that the fuel injector 114 is maintained in a fully open position, which is referred to as an injection pulse width.

The fuel injector 114 may inject fuel directly into the cylinder 110 as shown in FIG. 1. In other implementations, the fuel injector 114 may inject fuel into the intake manifold 104 at a central location or may inject fuel into the intake manifold 104 at multiple locations, such as near the intake valve of each of the cylinders.

The ECM 130 also controls the timing of initiation of combustion. In the diesel engine system 100, the ECM 130 controls the timing of initiation of combustion by controlling when fuel is injected into the cylinder 110. The heat generated though compression initiates combustion when fuel is injected into the cylinder 110. The time when fuel is supplied to the cylinder 110 may be specified relative to, for example, the TDC position or the BDC position.

Combustion of the air/fuel mixture drives the piston down, and the piston rotatably drives a crankshaft 118. The piston drives the crankshaft 118 down until the piston reaches the BDC position. The piston then begins moving up again and expels the byproducts of combustion through an associated exhaust valve 120. The byproducts of combustion are exhausted from the vehicle via an exhaust system 122.

One engine cycle, from the standpoint of one of the cylinders, involves two revolutions of the crankshaft 118 (i.e., 720° of crankshaft rotation). One engine cycle for one cylinder can be described in terms of four phases: an intake phase; a compression phase; a combustion phase; and an exhaust phase. For example only, the piston lowers toward the BDC position and air is drawn into the cylinder 110 during the intake phase. The piston rises toward the TDC position and compresses the contents (e.g., air or an air and fuel mixture) of the cylinder 110 during the compression phase. Fuel is supplied into the cylinder 110 and is combusted during the combustion phase, and the combustion drives the piston toward the BDC position. The piston rises toward the TDC to expel the resulting exhaust gas from the cylinder 110 during the exhaust phase.

The intake valve 112 is controlled by an intake camshaft 124, and the exhaust valve 120 is controlled by an exhaust camshaft 126. In other implementations, multiple intake camshafts may control multiple intake valves per cylinder and/or may control the intake valves of multiple banks of cylinders. Similarly, multiple exhaust camshafts may control multiple exhaust valves per cylinder and/or may control exhaust valves for multiple banks of cylinders.

An intake cam phaser 128 controls the intake camshaft 124 and, therefore, controls opening (e.g., lift, timing, and duration) of the intake valve 112. Similarly, an exhaust cam phaser 129 controls the exhaust camshaft 126 and, therefore, controls opening (e.g., lift, timing, and duration) of the exhaust valve 120. The timing of the opening of the intake and exhaust valves 112 and 120 may be specified relative to, for example, the TDC position or the BDC position. A phaser actuator module 132 controls the intake cam phaser 128 and the exhaust cam phaser 129 based on signals from the ECM 130.

The diesel engine system 100 may also include a boost device that provides pressurized air to the intake manifold 104. For example only, the diesel engine system 100 includes a turbocharger 134. The turbocharger 134 is powered by exhaust gases flowing through the exhaust system 122 and provides a compressed air charge to the intake manifold 104. The turbocharger 134 may include a variable geometry turbo (VGT) or another suitable type of turbocharger. Other engine systems may also include more than one turbocharger or boost device.

A wastegate 136 selectively allows exhaust gas to bypass the turbocharger 134, thereby reducing the turbocharger's output (or boost). A boost actuator module 138 controls boost of the turbocharger 134 based on signals from the ECM 130. The boost actuator module 138 may modulate the boost of the turbocharger 134 by, for example, controlling the position of the wastegate 136 or the turbocharger 134 itself (e.g., vane position).

An intercooler (not shown) may be implemented to dissipate some of the compressed air charge's heat. This heat may be generated when the air is compressed. Another source of heat is the exhaust system 122. Other engine systems may include a supercharger that provides compressed air to the intake manifold 104 and is driven by the crankshaft 118.

The diesel engine system 100 may also include an exhaust gas recirculation (EGR) valve 140, which selectively redirects exhaust gas back to the intake manifold 104. While the EGR valve 140 is shown in FIG. 1 as being located upstream of the turbocharger 134, the EGR valve 140 may be located downstream of the turbocharger 134. An EGR cooler (not shown) may also be implemented to cool redirected exhaust gas before the exhaust gas is provided to the intake manifold 104. An EGR actuator module 142 controls opening of the EGR valve 140 based on signals from the ECM 130. The EGR opening may be varied to adjust one or more combustion parameters and/or adjust the boost of the turbocharger 134.

The ECM 130 regulates the torque output of the engine 102 based on driver inputs and other inputs. The driver inputs may include, for example, accelerator pedal position, brake pedal position, cruise control inputs, and/or other suitable driver inputs. A driver input module 144 provides the driver inputs to the ECM 130. The other inputs may include, for example, inputs from various sensors and/or inputs from other vehicle control modules (not shown), such as a transmission control module, a hybrid control module, and a chassis control module.

The ECM 130 receives a crankshaft position signal from a crankshaft sensor 146. The crankshaft sensor 146 measures the position of the crankshaft 118 and outputs the crankshaft position signal accordingly. For example only, the crankshaft sensor 146 may include a variable reluctance (VR) sensor or another suitable type of crankshaft sensor.

The crankshaft position signal may include a pulse train. Each pulse of the pulse train may be generated as a tooth of an N-toothed wheel (not shown) that rotates with the crankshaft 118, passes the VR sensor. Accordingly, each pulse corresponds to an angular rotation of the crankshaft 118 by an amount equal to 360° divided by N teeth. The N-toothed wheel may also include a gap of one or more missing teeth, and the gap may be used as an indicator of one complete rotation of the crankshaft 118.

The ECM 130 also receives a cylinder pressure signal from a cylinder pressure sensor 148. For example only, one cylinder pressure sensor may be provided for each cylinder. The cylinder pressure sensor 148 measures pressure within the cylinder 110 and generates the cylinder pressure signal accordingly. The cylinder pressure sensor 148 may be implemented independently or with another component associated with the cylinder 110. The ECM 130 may also receive signals from other sensors, such as an engine coolant temperature sensor, a manifold absolute pressure (MAP) sensor, a mass air flow (MAF) sensor, a throttle position sensor, an intake air temperature (IAT) sensor, and/or other suitable sensors.

The diesel engine system 100 includes an idle control module 170 according to the principles of the present disclosure. While the idle control module 170 is shown as being located within the ECM 130, the idle control module 170 may be located in another suitable location, such as external to the ECM 130.

When the ECM 130 is in an idle mode, the idle control module 170 regulates the engine torque output to maintain the engine speed at a desired idle speed. For example only, the desired idle speed may initially be set to a predetermined idle speed (e.g., 700-1200 rpm). The idle control module 170 supplies desired amounts of fuel to the cylinders of the engine 102 to achieve the desired idle speed and determines the actual torque produced by each cylinder.

The idle control module 170 determines the actual torque produced by each cylinder based on cylinder pressures measured by the respective cylinder pressure sensor associated with each of the cylinders. For example only, the idle control module 170 determines the actual torque produced by the cylinder 110 based on cylinder pressures measured by the cylinder pressure sensor 148.

The idle control module 170 performs an imbalance analysis of the actual torques and determines a fuel balance factor for each cylinder based on each of the cylinders' respective torque imbalance (i.e., deviation from a mean torque). The respective fuel balance factors are applied to adjust the amount of fuel supplied to the cylinders during later occurring combustion events. The fuel balance factors balance the actual torques produced by the cylinders and minimize observable vibration.

Once the torque is balanced across the cylinders (i.e., after the fuel balance factors are applied), the idle control module 170 monitors the actual torque of each of the cylinders and performs a statistical analysis based on the actual torques. For example only, the idle control module 170 may determine the standard deviation of the actual torques from a mean torque. The idle control module 170 determines an idle speed reduction based on the result of the statistical analysis (e.g., the standard deviation). The idle control module 170 then reduces the desired idle speed by the amount of the idle speed reduction.

Figure 2:
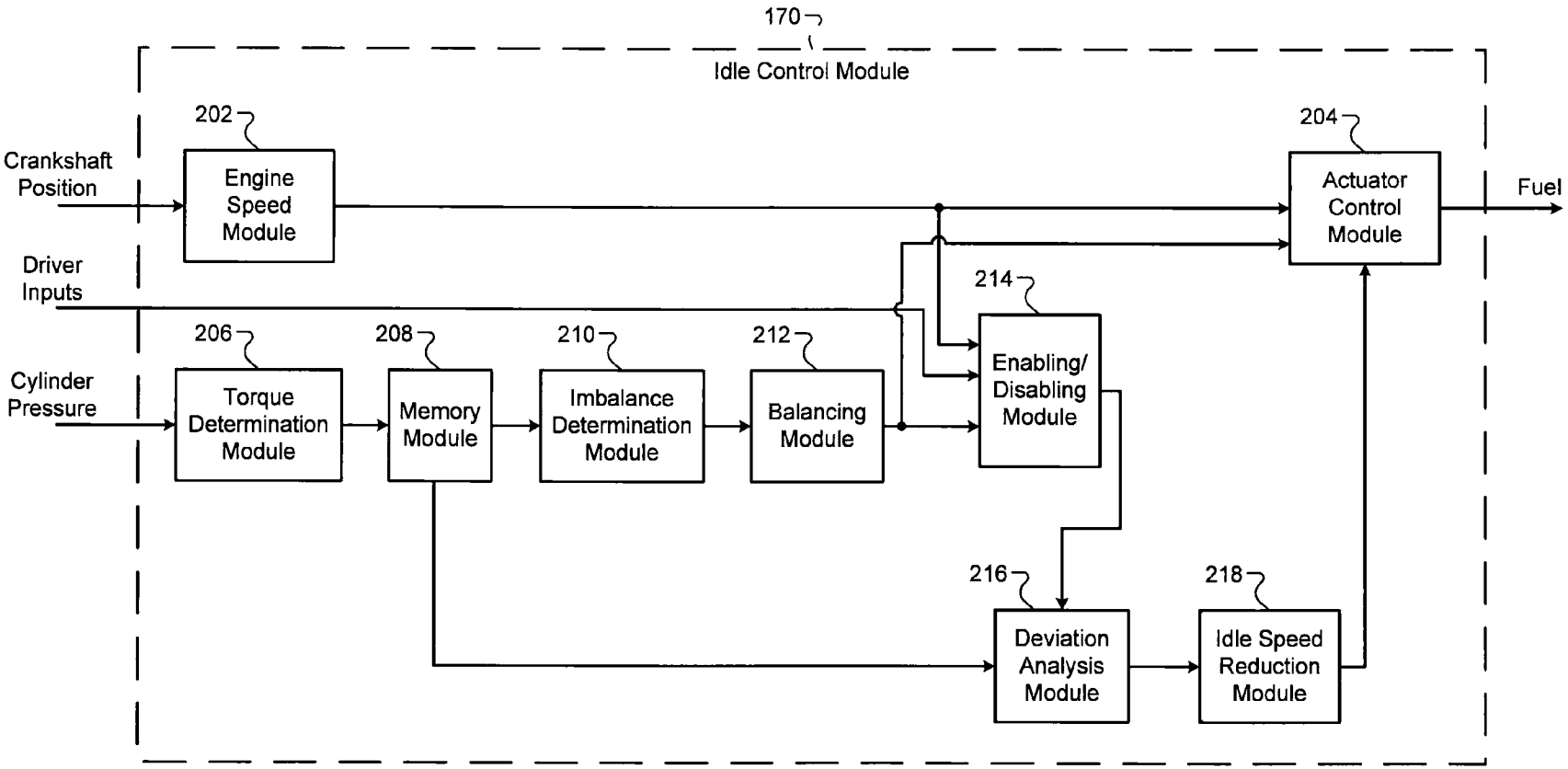
FIG. 2 is a functional block diagram of an exemplary idle control module according to the principles of the present disclosure.

Referring now to FIG. 2, a functional block diagram of an exemplary implementation of the idle control module 170 is presented. The idle control module 170 includes an engine speed module 202, an actuator control module 204, a torque determination module 206, and a memory module 208. The idle control module 170 also includes an imbalance determination module 210 and a balancing module 212. The idle control module 170 also includes an enabling/disabling module 214, a deviation analysis module 216, and an idle speed reduction module 218.

The engine speed module 202 determines the rotational speed of the engine 102 (i.e., the engine speed) in revolutions per minute (rpm). In one implementation, the engine speed module 202 determines the engine speed based on the crankshaft signal provided by the crankshaft sensor 146 and/or another suitable measure of the engine speed. For example only, the engine speed module 202 may determine the engine speed based on the period of time between the pulses of the pulse train output by the crankshaft sensor 146.

The actuator control module 204 controls engine actuators (and therefore torque production) to maintain the engine speed at approximately the desired idle speed when the ECM 130 is in an idle mode. The ECM 130 may be in the idle mode when, for example, the accelerator pedal is in a predetermined steady state position where the accelerator pedal rests when not being actuated by a driver.

The actuator control module 204 may determine a desired torque to maintain the engine speed at approximately the desired idle speed when the ECM 130 is in the idle mode. The actuator control module 204 determines a desired fuel amount for each of the cylinders of the engine 102 based on the desired torque and provides desired amount of fuel to the cylinders of the engine 102. The desired amounts of fuel may vary from cylinder to cylinder.

The torque determination module 206 determines the actual torque produced via combustion of the fuel supplied to the cylinder 110 based on the cylinder pressures measured by the cylinder pressure sensor 148 during combustion of the supplied fuel. The torque determination module 206 determines the actual torque produced for each of the other cylinders of the engine based on the cylinder pressures measured by the cylinder pressure sensor associated with the respective cylinders. Discussion of the determination of actual torque based on cylinder pressure measured by a cylinder pressure sensor can be found in commonly assigned U.S. patent application Ser. No. 12/367,975, the disclosure of which is herein incorporated in its entirety. The torque determination module 206 stores the actual torques produced by each of the cylinders in, for example, the memory module 208.

The imbalance determination module 210 accesses the stored actual torques and performs an imbalance analysis based on the actual torques. The imbalance determination module 210 may perform the imbalance analysis after each of the cylinders has completed one or more engine cycles. The imbalance determination module 210 determines a mean torque based on an average of the actual torques.

The imbalance determination module 210 determines a torque imbalance value for each of the cylinders based on a difference between the mean torque and the respective actual torques. For example only, the imbalance determination module 210 determines the torque imbalance value for the cylinder 110 based on the difference between the mean torque and the actual torque produced by the cylinder 110.

The balancing module 212 determines a fuel balancing factor for each of the cylinders based on the respective torque imbalance values. For example only, the balancing module 212 determines a fuel balance factor for the cylinder 110 based on the torque imbalance value determined for the cylinder 110. The fuel balance factors correspond to adjustments to the amount of fuel supplied to the respective cylinders that is necessary to adjust the actual torque output of the respective cylinders to approximately the mean torque.

The actuator control module 204 receives the fuel balancing factors and adjusts the amount of fuel supplied to the cylinders during later combustion events based on the respective fuel balance factors. In other words, the actuator control module 204 adjusts the amount of fuel supplied to the cylinders during later engine cycles based on the respective fuel balance factors. In this manner, the idle control module 170 balances the actual torques produced by the cylinders to minimize observable vibration during while the engine 102 is idling.

The enabling/disabling module 214 selectively enables and disables the deviation analysis module 216 based on whether the ECM 130 is in the idle mode. For example only, the enabling/disabling module 214 may enable the deviation analysis module 216 when the ECM 130 is in the idle mode. Written another way, the enabling/disabling module 214 may disable the deviation analysis module 216 when the ECM 130 is not in the idle mode. The enabling/disabling module 214 may determine that the ECM 130 is in the idle mode when, for example, the accelerator pedal is in the predetermined steady state position and the engine speed is approximately equal to the predetermined idle speed.

In some implementations, the enabling/disabling module 214 may selectively enable and disable the deviation analysis module 216 further based on whether fuel balancing has been performed while the ECM is in the idle mode. For example only, the enabling/disabling module 214 may enable the deviation analysis module 216 when fuel balancing has been applied and the ECM 130 is in the idle mode. Written another way, the enabling/disabling module 214 may disable the deviation analysis module 216 when fuel balancing has not been applied or when the ECM 130 is not in the idle mode. The enabling/disabling module 214 may determine that fuel balancing has been applied, for example, when the fuel balancing factors have been provided to the actuator control module 204 and/or when one or more of the fuel balancing factors are different than predetermined initial balancing factors.

The torque determination module 206 continues determining and storing the actual torques produced by each of the cylinders after fuel balancing is applied. The deviation analysis module 216 accesses the actual torques determined and performs a statistical analysis based on the actual torques. The deviation analysis module 216 may perform the statistical analysis once each of the cylinders has completed more than one engine cycle.

For example only, the statistical analysis performed by the deviation analysis module 216 may include a standard deviation analysis for each cylinder. In other words, the deviation analysis module 216 may determine the standard deviation of the actual torques for a given cylinder from a mean torque determined for that cylinder. The deviation analysis module 216 determines the mean torque for the given cylinder based on an average of the actual torques determined for that cylinder.

The idle speed reduction module 218 determines an idle speed reduction value based on the standard deviation of the actual torques. For example only, the idle speed reduction module 218 may determine the idle speed reduction value based on a mapping of idle speed reductions indexed by standard deviation. The idle speed reduction value may correspond to a speed by which the desired idle speed could be reduced while maintaining tolerable vibration levels. For example only, the idle speed reduction values may increase as the standard deviation approaches zero. In another implementation, the idle speed reduction module 218 may determine a reduced desired idle speed based on the standard deviation and update the desired idle speed to the reduced desired idle speed. At standard deviations greater than a predetermined value (e.g., 0.10-0.15 or 10-15%), the idle speed reduction module 218 may increase the desired idle speed. The standard deviation determined for one or more cylinders may be used in determining the idle speed reduction.

The idle speed reduction module 218 provides the idle speed reduction value to the actuator control module 204. The actuator control module 204 reduces the desired idle speed based on the idle speed reduction value. For example only, the idle speed reduction module 218 may decrease the desired idle speed by the idle speed reduction value. The actuator control module 204 then controls the engine actuators (e.g., the amount of fuel supplied) based on the reduced, desired idle speed.

Figure 3:
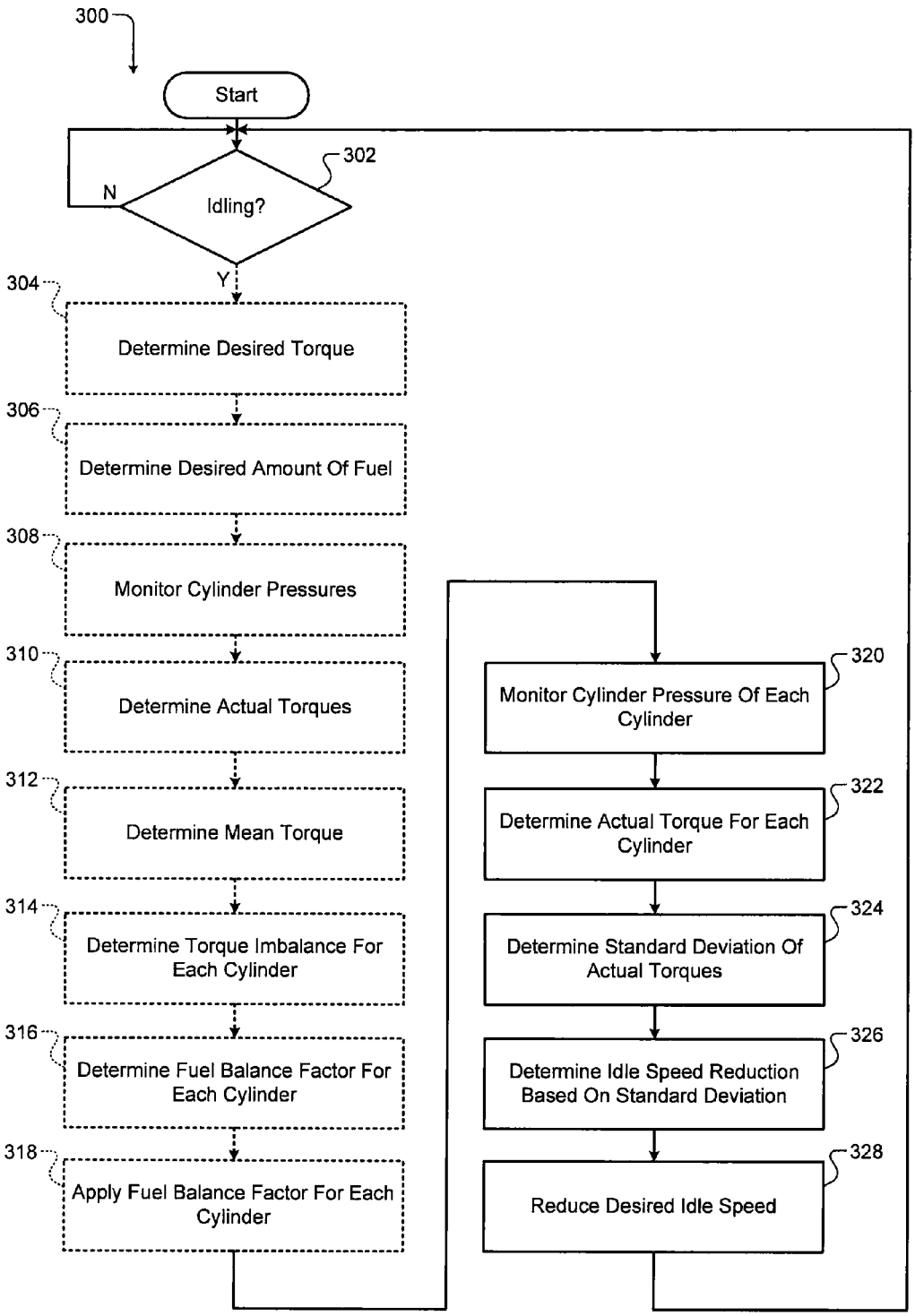
FIG. 3 is a flowchart depicting an exemplary method according to the principles of the present disclosure.

Referring now to FIG. 3, a flowchart depicting steps 300 performed by an exemplary method is presented. Control may begin in step 302 where control determines whether the engine 102 is idling. If true, control continues to step 304. If false, control remains in step 302. Control determines the desired torque in step 304. The desired torque corresponds to an amount of torque to be produced that is necessary to maintain the engine speed at the desired idle speed. The desired idle speed may be initially set to the predetermined idle speed.

In step 306, control determines the desired amount of fuel to be supplied. Control may determine a desired amount of fuel for each of the cylinders of the engine 102 in step 306. Control determines the desired amount(s) of fuel based on the desired torque. Control monitors the cylinder pressures measured by the cylinder pressure sensor associated with each of the cylinders in step 308.

Control determines the actual torque produced by each of the cylinders in step 310. Control determines the actual torque produced by each of the cylinders based on the cylinder pressures measured by the associated cylinder pressure sensor during the combustion events of the respective cylinders. Control determines the mean torque in step 312. Control determines the mean torque based on the average of the actual torques.

Control determines the torque imbalance value for each of the cylinders in step 314. For example only, control determines the torque imbalance value for one of the cylinders based on the difference between the mean torque and the actual torque produced by that cylinder. Control determines the fuel balance factor for each of the cylinders in step 316. Control determines the fuel balance factor for one of the cylinders based on the torque imbalance value of that cylinder. In step 318, control applies the fuel balance factors. More specifically, control adjusts the amounts of fuel supplied to each of the cylinders during later combustion events (i.e., engine cycles) based on the respective fuel balance factors.

Control may then continue in step 320 where control monitors the cylinder pressures measured by the cylinder pressure sensor associated with each of the cylinders. In some implementations, control and the steps 300 may continue in step 320 after step 302. In this manner, control may continue to step 320 when the engine 102 is idling in step 302.

Control determines the actual torque produced by each of the cylinders in step 322. Control determines the actual torque produced by each of the cylinders based on the cylinder pressures measured by the associated cylinder pressure sensor during the combustion events of the respective cylinders. Control determines the standard deviation of the actual torques for each of the cylinders in step 324.

In step 326, control determines the idle speed reduction value based on the standard deviation. In another implementation, control determines a reduced desired idle speed in step 326. The standard deviation of one or more of the cylinders may be used in determining the idle speed reduction.

Control continues to step 328 where control reduces the desired idle speed. Control reduces the idle speed based on the idle speed reduction value. In implementations where the reduced desired idle speed is determined, control may update the desired idle speed to the reduced desired idle speed. Control returns to step 302 after step 328 is performed.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. An idle control system for a vehicle, comprising:

an actuator control module that regulates an engine speed based on a desired idle speed when an engine idle mode is enabled;

a torque determination module that determines actual torques for a cylinder of an engine while the engine idle mode is enabled;

a deviation analysis module that determines a standard deviation based on more than one of the actual torques while the engine idle mode is enabled; and an idle speed reduction module that determines an idle speed reduction based on the standard deviation and that decreases the desired idle speed based on the idle speed reduction.

2. The idle control system of claim 1 wherein the idle speed reduction module determines a second desired idle speed based on the standard deviation and updates the desired idle speed to the second desired idle speed, and wherein the second desired idle speed is less than the desired idle speed.

3. The idle control system of claim 1 wherein the idle speed reduction module subtracts the idle speed reduction from the desired idle speed.

4. The idle control system of claim 1 further comprising an enabling/disabling module that disables the deviation analysis module when the engine idling mode is disabled.

5. The idle control system of claim 1 wherein the torque determination module determines the actual torques based on at least one cylinder pressure measured by a cylinder pressure sensor of the cylinder.

6. The idle control system of claim 1 wherein the actuator control module adjusts at least one engine operating parameter based on the desired idle speed.

7. The idle control system of claim 1 wherein the actuator control module reduces an amount of diesel fuel supplied to the cylinder in response to the decrease.

8. The idle control system of claim 1 wherein the torque determination module determines actual torques for one or more other cylinders of an engine, respectively, while the engine idle mode is enabled, wherein the deviation analysis module determines a standard deviation for each of the one or more other cylinders based on more than one of the actual torques for the one or more other cylinders, respectively, while the engine idle mode is enabled, and wherein the idle speed reduction module determines the idle speed reduction based on one or more of the standard deviations.

9. The idle control system of claim 8 further comprising:

an imbalance analysis module that determines torque imbalances for the cylinders, respectively, while the engine idle mode is enabled; and a balancing module that balances the actual torques across the cylinders while the engine idle mode is enabled.

10. The idle control system of claim 9 wherein the balancing module determines fuel balancing factors based on the torque imbalances of each of the cylinders, respectively, and adjusts an amount of fuel supplied to the cylinders based on the fuel balancing factors, respectively.

11. An idle control method for a vehicle, comprising:

regulating an engine speed based on a desired idle speed when an engine idle mode is enabled;

determining actual torques for a cylinder of an engine while the engine idle mode is enabled;

determining a standard deviation based on more than one of the actual torques while the engine idle mode is enabled;

determining an idle speed reduction based on the standard deviation; and decreasing the desired idle speed based on the idle speed reduction.

12. The idle control method of claim 11 further comprising:

determining a second desired idle speed based on the standard deviation; and updating the desired idle speed to the second desired idle speed, wherein the second desired idle speed is less than the desired idle speed.

13. The idle control method of claim 11 further comprising subtracting the idle speed reduction from the desired idle speed.

14. The idle control method of claim 11 further comprising disabling the determining the standard deviation when the engine idling mode is disabled.

15. The idle control method of claim 11 further comprising determining the actual torques based on at least one cylinder pressure measured by a cylinder pressure sensor of the cylinder.

16. The idle control method of claim 11 further comprising adjusting at least one engine operating parameter based on the desired idle speed.

17. The idle control method of claim 11 further comprising reducing an amount of diesel fuel supplied to the cylinder in response to the decreasing.

18. The idle control method of claim 11 further comprising:

determining actual torques for one or more other cylinders of an engine, respectively, while the engine idle mode is enabled;

determining a standard deviation for each of the one or more other cylinders based on more than one of the actual torques for the one or more other cylinders, respectively, while the engine idle mode is enabled; and determining the idle speed reduction based at least one of the standard deviations.

19. The idle control method of claim 18 further comprising:

determining torque imbalances for the cylinders, respectively, while the engine idle mode is enabled; and balancing the actual torques across the cylinders while the engine idle mode is enabled.

20. The idle control method of claim 19 further comprising:

determining fuel balancing factors based on the torque imbalances of each of the cylinders, respectively; and adjusting an amount of fuel supplied to the cylinders based on the fuel balancing factors, respectively.

* * * * *